US006354347B1

(12) United States Patent
Brewer

(10) Patent No.: US 6,354,347 B1
(45) Date of Patent: Mar. 12, 2002

(54) ROUTER BIT FOR FORMING RAISED DOOR PANELS

(75) Inventor: James Mitchell Brewer, Mocksville, NC (US)

(73) Assignee: Freud TMM, Inc., High Point, NC (US)

( * ) Notice: Subject to any disclaimer, the term of this patent is extended or adjusted under 35 U.S.C. 154(b) by 0 days.

(21) Appl. No.: 09/756,257

(22) Filed: Jan. 8, 2001

(51) Int. Cl.[7] ..... B27G 5/00; B27C 5/00

(52) U.S. Cl. ..... 144/218; 144/134.1; 144/135.2; 144/137; 144/219; 407/31; 409/234

(58) Field of Search ..... 144/3.1, 134.1, 144/137, 135.2, 218, 228, 90, 91, 91.2, 219, 220; 407/31, 53, 54, 64; 409/209, 218, 234, 226

(56) References Cited

U.S. PATENT DOCUMENTS 283,678 A * 8/1883 Steele ..... 144/236
2,915,095 A * 12/1959 Pelto ..... 144/219
5,433,563 A * 7/1995 Velepec ..... 409/234
5,615,718 A * 4/1997 Venditto ..... 144/91
5,996,659 A * 12/1999 Burgess ..... 144/135.2
6,019,148 A * 2/2000 Hansen ..... 144/135.2

OTHER PUBLICATIONS

Amana Tool 2001/2002 Catalog (2 pages).
Sommerfeld's Tools for Wood Catalog (2 pages).
Freud General Products Catalog (6 pages).
Eagle America—Special Millenium Edition Catalog (2 pages).

* cited by examiner

*Primary Examiner*—W. Donald Bray
(74) *Attorney, Agent, or Firm*—Kennedy Covington Lobdell & Hickman, LLP

(57) ABSTRACT

A router bit for forming the edges of a raised door panel which includes a rotatable drive shaft, a profile cutter fixed to the drive shaft, and a back cutter fixed to the drive shaft for rotation therewith. A cylindrically-shaped pilot member is disposed intermediate the profile cutter and the back cutter. The pilot member is fixed to the drive shaft for rotation therewith and the exterior surface of the pilot member is coated with a friction-reducing material to reduce or eliminate any significant friction between the exterior surface of the rotating pilot member and the raised door panel.

3 Claims, 3 Drawing Sheets

ROUTER BIT FOR FORMING RAISED DOOR PANELS

BACKGROUND OF THE INVENTION

Many different aesthetically pleasing doors are made with an open rectangular frame portion formed by a pair of rails and a pair of styles, and a raised panel which is rectangular in shape and has a decorative profile cut into its peripheral edges, with the edges of the raised panel also being formed with a tongue portion that is received in correspondingly shaped grooves cut in the frame.

In conventional cutting methods, there are at least two known techniques for forming the edges of the raised panel with the required decorative profile and the tongue portion. First, it is known to use two separate cutters in two separate cutting steps. In one cutting step, the cutter is shaped to cut the required back cut in the edges of the raised door panel, and in a second cutting step another cutter is used, this cutter being designed to cut the desired decorative profile in the edge of the raised door panel. While this method of forming the edges the raised door panel results in an entirely acceptable raised door panel, it obviously is time consuming in that two separate cutting steps are required.

Alternatively, it is also know to mount both a back cutter and a profile cutter on the same drive shaft to form a router bit that will make both cuts simultaneously, but these router bits also suffer from several disadvantages. More specifically, from an architectural and aesthetically pleasing standpoint, it is preferred that the overall profile formed at the edges of the raised door panel has a total length of one and one-half inch. However, a router bit of this type must have a pilot member disposed between the profile cutter and the back cutter and rotatably mounted on the drive shaft of the router bit so that the exterior cylindrical surface of the pilot member can abut the end face of the edge of the raised door panel and provide a guide to properly determine the length of the profile being formed. Since the pilot member is mounted for rotation on the drive shaft using ball bearing so that it will not rotate with the drive shaft and create unacceptable friction with the abutting end face of the raised door panel, the pilot member has a radial dimension of approximately one-half inch. If the overall radius of the profile cutter is about one and three-quarter inch, the actual length of the profile cut by the router bit will be less than one and one-half of an inch because of the radius of the drive shaft and radius of the pilot member, and this length is obviously less than the preferred length of one and one-half inch as discussed above.

On the other hand, it is generally not feasible to simply increase the radius of the profile cutter to accommodate the radius of the rotating pilot member because the increase in the radius of the profile cutter creates unacceptable risks created by the increased speed at the tip of the profile cutter that can create a potentially dangerous situation for the operator of the equipment.

Thus, it is now common practice to use a router bit which includes both the back cutter and the profile cutter to thereby eliminate the necessity of making two separate cuts, but the result is that the length of the profile is less than the desired one and one-half inch.

In accordance with the present invention, a router bit includes both a back cutter and a profile cutter, and it is still capable of forming a profile of one and one-half inch without increasing the radius of the profile cutter.

SUMMARY OF THE INVENTION

The present invention provides a router bit for forming the edges of a raised door panel which includes a rotatable drive shaft, a profile cutter fixed to the drive shaft for rotation therewith to form a decorative profile at the edge of the raised door panel, and a back cutter fixed to the drive shaft for rotation therewith to simultaneously form a back cut relief in the same edge of the raised door panel. A cylindrically-shaped pilot member is disposed intermediate the profile cutter and the back cutter so that the exterior surface of the pilot member can be in abutment with the raised door panel to properly locate door panel relative to the profile cutter and the back cutter during the cutting of the raised door panel. The pilot member is fixed to the drive shaft for rotation therewith and the exterior surface of the pilot member is coated with a friction-reducing material to reduce or eliminate any significant friction between the exterior surface of the rotating pilot member and the raised door panel.

In the preferred embodiment of the present invention, the friction-reducing material is Teflon, and the back cutter and the profile cutter are shaped to cut a tongue in the edge of the raised door panel so that the end face of the tongue abuts the exterior surface of the rotating pilot member during cutting of the raised door panel.

DESCRIPTION OF THE PREFERRED EMBODIMENT

Figure 1:
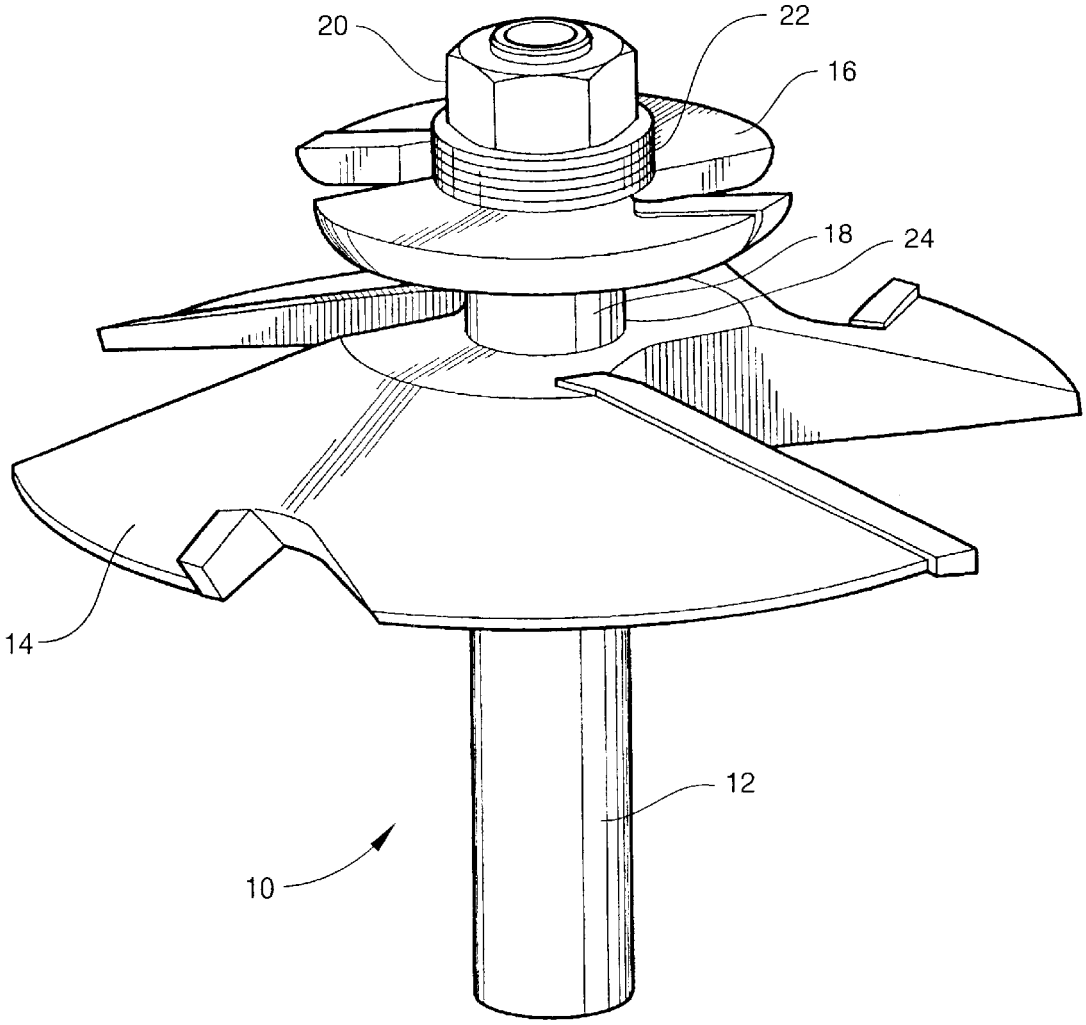
FIG. 1 is a perspective view of a preferred embodiment of the router bit of the present invention.
Figure 2:
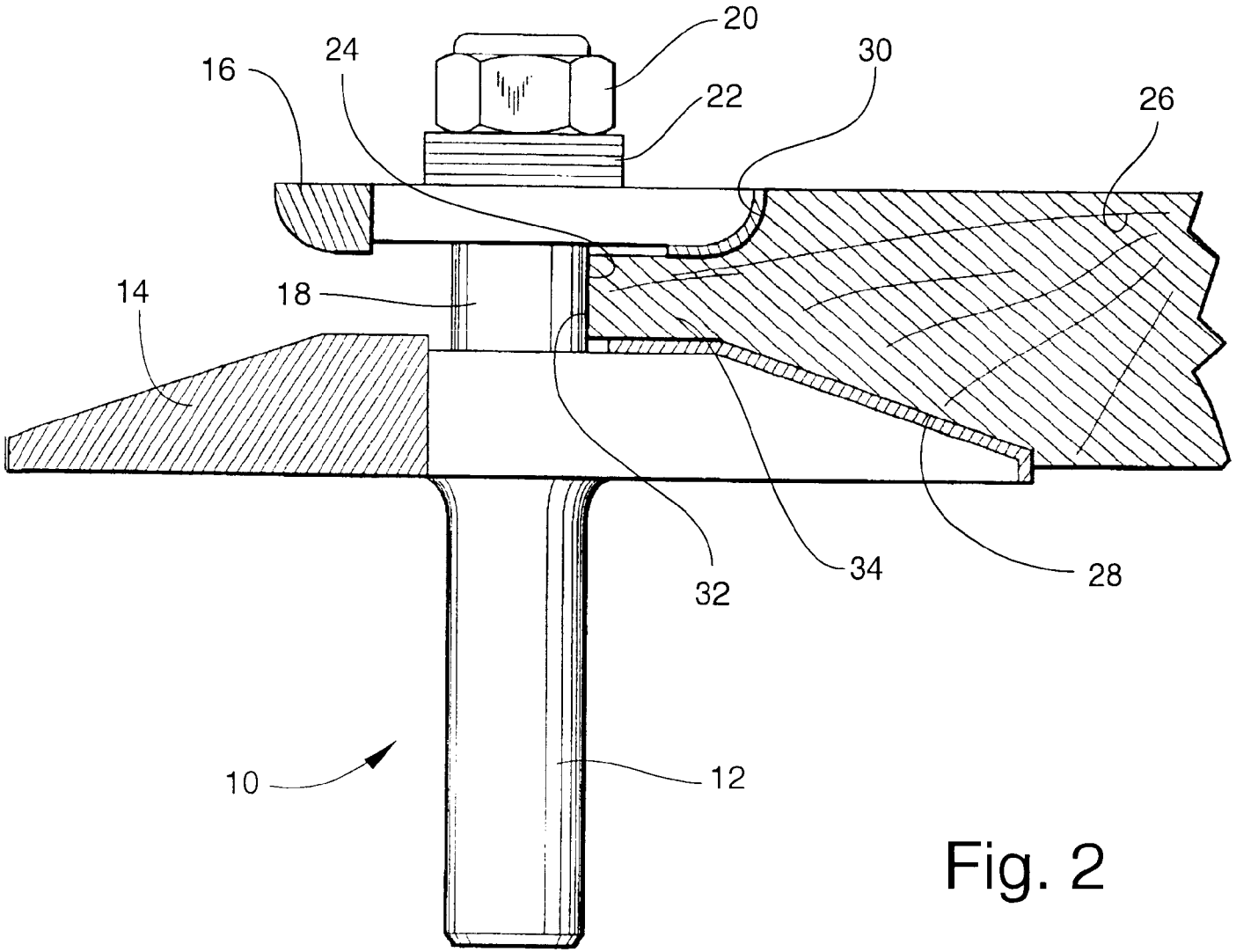
FIG. 2 is a side elevational view of the router bit illustrated in FIG. 1.

Looking now in greater detail at the accompanying drawings, FIGS. 1 and 2 illustrate a router bit 10 or forming the edges of a raised door panel in accordance with the present invention.

The router bit 10 includes a drive shaft 12. A profile cutter 14 is mounted on the drive shaft 12 for rotation therewith, and, likewise, a back cutter 16 is also mounted on the drive shaft 12 for rotation therewith. Intermediate the profile cutter 14 and the back cutter 16 is a cylindrically-shaped pilot member 18 that is fixed to the drive shaft 12 for rotation therewith. A nut 20 is threadably mounted at the upper end of the drive shaft 12 to maintain all of the elements on the drive shaft 12 in place, and, if desired, a plurality of shims 22 may be removably mounted on the drive shaft 12 either below or above the back cutter 16 to vary position of the back cutter 16 on the drive shaft 12 and thereby vary the axial spacing between the back cutter 16 and the profile cutter 14.

In accordance with the present invention, the exterior cylindrical surface 24 of the pilot member 18 is coated with a friction-reducing material for a purpose to be described in greater detail below. The friction-reducing material may be a polymer having friction-reducing capabilities. Preferred friction-reducing polymers include, but are not limited to, fluorocarbon polymers. Particularly preferred fluorocarbon polymers are tetrafluoroethylene (TFE) fluorocarbon polymers and fluorinated ethylene-propylene (FEP) polymers. Such TFE polymers and FEP polymers are commercially available as TEFLON® from E.I. du Pont de Nemours and Company.

As best seen in FIG. 2, the edges of a raised door panel 26 maybe formed with a profile 28 and a back cut 30 (see FIG. 3) by laterally moving the rotating router bit 10 into contact with the edge portion of the raised door panel 26. This advancing movement of the router bit 10 continues, with the profile cutter 14 and the back cutter 16 gradually cutting away the edge portion of the raised door panel 26, until the end face 32 contacts the pilot member 18, at which point the edge portion of the raised door panel has been properly formed by the profile cutter 14 and the back cutter 16.

Figure 3:
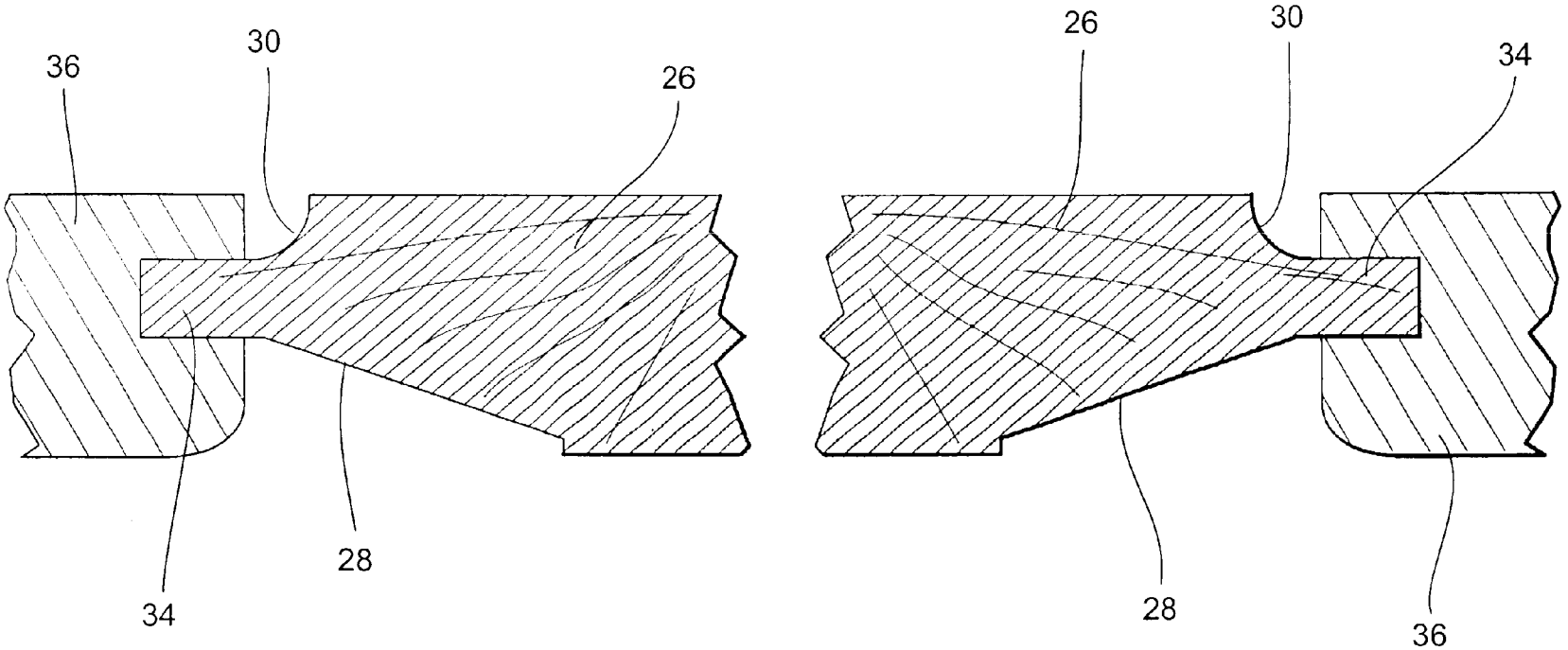
FIG. 3 is a detail view illustrating a raised door panel formed by the router bit of the present invention and a portion of the door frame with the tongue of the raised door panel fitted within grooves of the door frame.

In looking at FIGS. 2 and 3, it will be noted that the length of the profile 28 is determined by the radius of the profile cutter 14 minus the radius of the pilot member 18. In accordance with the present invention, this relationship is capable of creating a profile 28 having an architectural and aesthetically desirable overall length of one and one-half inch without exposing the user of the equipment to any increased safety risk.

More specifically, conventional router bits of the type generally illustrated in FIG. 2 include a pilot member mounted on the drive shaft intermediate the two cutters with a ball bearing arrangement that permits the drive shaft to rotate relative to the pilot member, as discussed above. By virtue of this arrangement, when the end face of the profile being cut comes into abutment with the outer cylindrical surface of the ball bearing mounted pilot member, there is no significant friction between the abutting surfaces because the ball bearing mounting of the pilot member permits the drive shaft to rotate relative to the pilot member so that the abutting surface of the pilot member is substantially stationary relative to the abutting end face of the profile. However, as discussed above, the required ball bearing mounting of the pilot member inherently results in an increase in the overall radius of the pilot member, and, looking at FIG. 2, it will be apparent that this increase in the radius of the pilot member will necessarily result in reducing the overall length of the profile being cut by router bit 10, and the end result is that the overall length of the profile cut by the router bit is less than the desired one and one-half inch length.

By contrast, the pilot member 18 of the present invention has no ball bearing mounting, and it is simply a solid cylindrical element that can be fixed to the drive shaft 12 without significantly increasing the radius of the drive shaft 12. Accordingly, the reduced diameter of the pilot member 18 (as compared to a ball bearing pilot member) permits a standard size profile cutter 14 to be used and still obtain the desired profile length of one and one-half inch without increasing the safety risk to the user. Moreover, when the end face 32 of the raised door panel 26 comes into abutment with the exterior surface 24 of the pilot member 18, the friction-resisting coating on the exterior surface 24 significantly reduces the friction resulting from such abutment to such extent that there is no danger that the end face 32 of the raised door panel 26 will be burned or otherwise adversely affected by the contact between the end face 32 and the outer surface 24 of the pilot member 18 even though the pilot member 18 is rotating with the drive shaft 12.

Although it will be appreciated that the router bit 10 of the present invention maybe used with a variety of conventional profile cutters 14 and back cutters 16 to form various decorative shapes at the edges of the raises door panel 26, one typical raised door panel 26 that can be formed using the present invention is illustrated in FIG. 3. The raised door panel 26 has a profile 28 formed in the top surface thereof, a back cut 30 formed in the bottom side, and a tongue portion 34 which can be inserted in grooves 36 formed in the door frame members 38. It will be noted that the back cut 30 permits the tongue portion 34 to be inserted in the groove 38 in such a way that the thickness of the raised door panel 26 maybe identical to the thickness of the door frame 36, which is a desired feature of raised door panels. Additionally, the profile 28 at the edges of the raised door panel 26 has a desired length of one and one-half inch.

The representative raised door panel 26 as illustrated in FIG. 3 would be formed by one typical router bit 10 of the present invention which would include a profile cutter 14 having a radius of one and three-quarter inch, a back cutter 16 having a radius of three-quarter inch, and a pilot member 18 having a radius of one quarter inch. This typical router bit 10 would be rotated by an electric motor having a horse power of two and one-half to three and one-half, and which would result in the router bit 10 being rotated at a speed of eight thousand to twelve thousand rpm. However, it is to be expressly understood that this is simply one example of a wide variety of router bits 10 that can be constructed in accordance with principals of the present invention.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the invention has been described herein in detail in relation to its preferred embodiment, it is to be understood that this disclosure is only illustrative and exemplary or the present invention and is made merely for purposes of provided a full and enabling disclosure of the invention. The foregoing discussion is not intended or to be construed to limit the present invention of otherwise to exclude any such other embodiments, adaptations, variations, modifications and equivalent arrangements.

What is claimed is:

1. A router bit for forming the edges of a raised door panel which includes a rotatable drive shaft, a profile cutter fixed to said drive shaft for rotation therewith to form a decorative profile at the edge of the raised door panel, a back cutter fixed to said drive shaft for rotation therewith to simultaneously form a back cut relief in the same edge of the raised door panel, and a cylindrically-shaped pilot member disposed intermediate said profile cutter and said back cutter so that the exterior surface of said pilot member can be in abutment with the raised door panel to properly locate the door panel relative to said profile cutter and said back cutter during the cutting of the raised door panel, said pilot member being fixed to said drive shaft for rotation therewith and the exterior surface of said pilot member being coated with a friction reducing material to reduce or eliminate any significant fiction between the exterior surface of the rotating pilot member and the raised door panel.

2. A router bit as defined in claim 1, wherein said friction-reducing material is Teflon.

3. A router bit as defined in claim 1, wherein said back cutter and said profile cutter are shaped to cut a tongue in the edge of the raised door panel, and wherein the end face of said tongue abuts said exterior surface of said rotating pilot member during cutting of said raised door panel.

* * * * *